US010210969B2

(12) United States Patent
Sjöberg et al.

(10) Patent No.: US 10,210,969 B2
(45) Date of Patent: Feb. 19, 2019

(54) ELECTRICAL BUSHING

(71) Applicant: ABB Schweiz AG, Baden (CH)

(72) Inventors: Peter Sjöberg, Ludvika (SE); Robert Floresjö, Borlänge (SE); Roger Hedlund, Ludvika (SE); Simon Lindgren, Borlänge (SE); Ylva Granbom, Falun (SE); Christian Söderlund, Falun (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/573,271

(22) PCT Filed: May 19, 2016

(86) PCT No.: PCT/EP2016/061302
§ 371 (c)(1),
(2) Date: Nov. 10, 2017

(87) PCT Pub. No.: WO2016/188863
PCT Pub. Date: Dec. 1, 2016

(65) Prior Publication Data

US 2018/0102205 A1 Apr. 12, 2018

(30) Foreign Application Priority Data

May 22, 2015 (EP) ..... 15168820

(51) Int. Cl.
*H01B 17/26* (2006.01)
*H01B 17/34* (2006.01)
(Continued)

(52) U.S. Cl.
CPC ..... *H01B 17/34* (2013.01); *H01B 17/30* (2013.01); *H01F 27/04* (2013.01)

(58) Field of Classification Search
CPC ..... H01B 17/34; H01B 17/00; H01B 17/26; H01B 17/005; H01B 17/303;
(Continued)

(56) References Cited

U.S. PATENT DOCUMENTS 3,585,278 A 6/1971 Quirk
4,291,193 A 9/1981 Stemler et al.
(Continued)

FOREIGN PATENT DOCUMENTS

EP 1134750 A2 9/2001
GB 792460 A 3/1958
WO 2008027007 A1 3/2008

OTHER PUBLICATIONS

Extended European Search Report Application No. 15168820.7 Completed Date: Dec. 3, 2015; dated Dec. 15, 2015 9 Pages.
(Continued)

*Primary Examiner* — Angel R Estrada
(74) *Attorney, Agent, or Firm* — Whitmyer IP Group LLC

(57) ABSTRACT

An electrical bushing including an electrically insulating shell having a central longitudinal through hole and a first longitudinal end configured to be at a top of the bushing and a second longitudinal end configured to be at a bottom of the bushing. The bushing is configured for accommodating an electrical conductor positioned through the central longitudinal through hole of the shell. The shell includes fastening means for fastening the bushing to a wall of an electrical apparatus, through which wall the bushing is configured for allowing the electrical conductor to pass. The shell is configured for sealingly containing an electrically insulating liquid in the bushing, allowing the bushing to be liquid-filled. The shell is molded as a single piece from an electrically insulating polymeric material.

15 Claims, 2 Drawing Sheets

(51) Int. Cl.
*H01F 27/04* (2006.01)
*H01B 17/30* (2006.01)

(58) Field of Classification Search
CPC ..... H01B 17/265; H01B 17/28; H01B 17/50; H01F 27/04; H01F 27/00; H02G 3/22; H02G 3/04; H02G 3/24; H02G 3/30; H02G 3/36; H02G 15/34; H02G 15/20; H02G 3/083; F16L 5/02; F16L 5/00; B60R 16/0215; B60R 16/0207; B60R 16/0222
USPC .... 174/152 R, 140 R, 142, 144, 650, 11 BH, 174/14 BH, 31 R, 141 C; 16/2.1, 2.2
See application file for complete search history.

(56) References Cited

U.S. PATENT DOCUMENTS 4,312,123 A 1/1982 Wheeler
4,401,841 A * 8/1983 Meyer ..... H01B 17/36 174/31 R
4,965,407 A 10/1990 Hamm
6,271,470 B1 * 8/2001 Geibel ..... H01B 17/34 174/135
6,333,462 B1 12/2001 Quaggia
6,610,933 B2 8/2003 Baker et al.
7,262,367 B2 * 8/2007 Donzel ..... H01B 17/28 174/137 R
7,812,266 B2 * 10/2010 Rocks ..... H01B 17/265 16/2.1
7,964,799 B2 * 6/2011 Isberg ..... H01B 17/303 16/2.1
8,471,150 B2 * 6/2013 Emilsson ..... H01B 17/28 174/140 R
8,637,773 B2 * 1/2014 Jonsson ..... B29C 70/58 174/137 B
2002/0104679 A1 8/2002 Krol et al.
2009/0028878 A1 1/2009 Bergstein

OTHER PUBLICATIONS

Written Opinion of International Preliminary Examining Authority Application No. PCT/EP2016/061302 dated Apr. 7, 2017 8 Pages.
PCT International Search Report & Written Opinion Application No. PCT/EP2016/061302 Completed Date: Jul. 14, 2016; dated Aug. 8, 2016 14 Pages.

* cited by examiner

ELECTRICAL BUSHING

TECHNICAL FIELD

The present disclosure relates to a liquid-filled electrical bushing, e.g. for a transformer.

BACKGROUND

A bushing is a hollow electrical insulator through which a conductor may pass. Bushings are used where high voltage lines must pass through a wall or other surface, on switchgear, transformers, circuit breakers and other high voltage equipment. A bushing is e.g. used for passing a high voltage line from an oil-filled transformer, whereby the bushing is an oil-to-air bushing with a part in oil in the transformer and a part in air outside of the transformer. Other bushings are air-to-air bushings e.g. passing high voltage lines through a wall.

A bushing may be oil-filled e.g. through a transformer tank wall, consisting of several outer parts, for instance a top piece of aluminium, an upper part of porcelain with ridges, a middle part of aluminium with a flange for fastening the bushing to the transformer tank, and a bottom part of porcelain. These different parts need to be sufficiently sealed to each other to reduce the risk of oil leaks from the oil-filled bushing (as well as the risk of moisture and dirt getting into the bushing).

Another type of oil-leakage problem is addressed in U.S. Pat. No. 6,610,933 which discloses the use of a moulded bushing assembly (e.g. epoxy-based and moulded in a one-step moulding process) for an oil-filled transformer. The document is focused on the sealing attachment of the bushing to the transformer casing to avoid oil leakage while still allowing the bushing to be detachable. The bushing itself is not oil-filled. Rather, the conductor may be integrally moulded in the bushing.

SUMMARY

It is an objective of the present invention to provide a liquid-filled bushing with reduced risk of liquid (e.g. oil) leakage from the bushing.

According to an aspect of the present invention there is provided an electrical bushing comprising an electrically insulating shell having a central longitudinal through hole as well as a first longitudinal end configured to be at a top of the bushing and a second longitudinal end configured to be at a bottom of the bushing. The bushing is configured for accommodating an electrical conductor positioned through the central longitudinal through hole of the shell. The shell comprises fastening means for fastening the bushing to a wall of an electrical apparatus, through which wall the bushing is configured for allowing the electrical conductor to pass. The shell is configured for sealingly containing an electrically insulating liquid in the bushing, allowing the bushing to be liquid-filled. The shell is moulded as a single piece from an electrically insulating polymeric material. The moulded shell of the present invention replaces the upper porcelain part, the aluminium middle flange, the porcelain bottom part and all the seals between the flange and porcelain parts of the exemplary prior art bushing.

According to another aspect of the present invention there is provided an electrical apparatus comprising an embodiment of a bushing of the present disclosure. The bushing is liquid-filled, extends through the wall of the electrical apparatus and is fastened to said wall by means of the fastening means.

According to another aspect of the present invention there is provided a method of moulding a shell for an embodiment of the electrical bushing of the present disclosure as a single piece from an electrically insulating polymeric material.

By the shell being moulded as a single (monolithic, undivided) part without joints, the number of joints/interfaces at which the insulating liquid may leak out of the liquid-filled bushing, as well as water and dirt getting inside the bushing, is reduced compared with a conventional oil-filled bushing. Thus, the shell of the present invention can replace the porcelain upper part, the aluminium middle part and the porcelain bottom part of the above discussed prior art, reducing the number of joints of the bushing. Joints may still be present at the ends of the shell, e.g. to a top lid and/or to the conductor or a tube configured for having the conductor run through it. Also, fastening means for fastening the bushing to the apparatus wall 7 can be conveniently integrated in (moulded into) the moulded shell.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

The bushing of the present invention may be used for a transformer, e.g. a power transformer, as exemplified herein, but the inventive bushing may alternatively be used for other electrical devices, especially fluid-filled (e.g. oil) electrical devices, such as electrical motors or switches.

Figure 1:
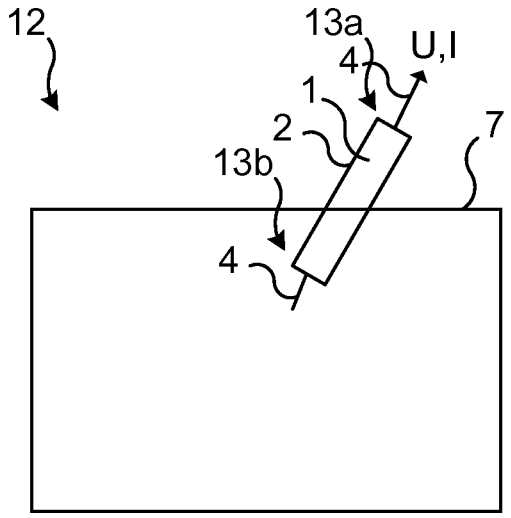
FIG. 1 is a schematic side view, in section, of an embodiment of an electrical apparatus comprising a bushing, in accordance with the present invention.

FIG. 1 is a schematic illustration of an electrical apparatus 12 in the form of a transformer where a bushing 1 having a shell 2 is used for conducting an electrical current (I, U) in a conductor 4 through the casing/wall 7 of the transformer 12. The transformer may be an oil-filled transformer, e.g. filled with mineral oil or an ester-based oil. The transformer may be a high-voltage power transformer, whereby a high-voltage current is passed from the transformer through the conductor 4 of the bushing 1. The bushing 1 may thus have an inner oil-immersed part at a lower/bottom end 13*b* of the bushing inside the transformer 12, and an outer part in air at an upper/top end 13*a* of the bushing 1 outside of the transformer. The bushing 1 may be fully or partly fluid-filled, typically filled with an insulating liquid e.g. an oil. The bushing, by means of its associated conductor 4, may conduct current from e.g. a winding of the transformer, through the wall 7 of the transformer and to e.g. an air-borne line of a power distribution network, the bushing 1 insulating the current from the wall and any other external structures.

Figure 2:
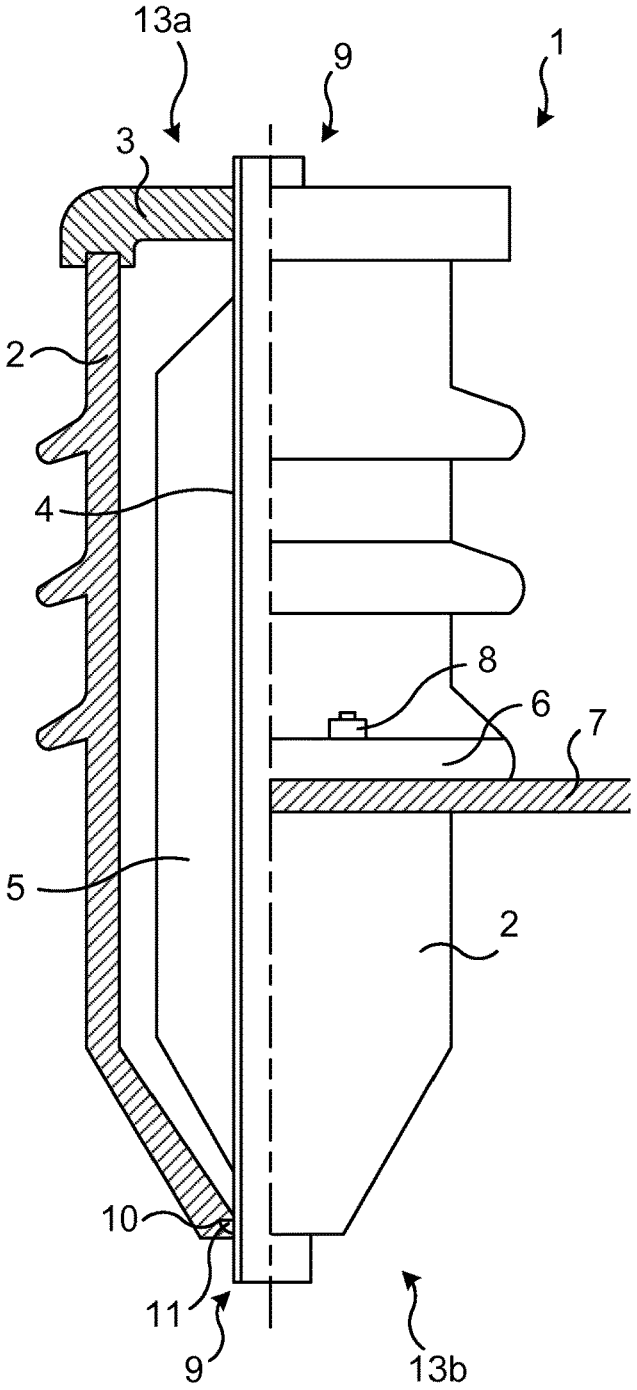
FIG. 2 is a schematic longitudinal cut-out view of an embodiment of a bushing in accordance with the present invention.

FIG. 2 is a schematic illustration of an embodiment of a bushing 1, in which the left side of the FIG. is in longitudinal section while the right side is a longitudinal side view. Through the bushing (vertically in the figure) runs a longitudinal through hole 9, through which an electrical conductor 4 runs.

Alternatively, the conductor may run through a pipe or tube, e.g. a winding tube, positioned in the longitudinal through hole 9 to facilitate removal and exchange of the conductor. The conductor may be a conventional solid or pipe-formed conductor, e.g. of copper or aluminium. The bushing is filled with an electrically insulating liquid, e.g. an oil such as a mineral oil or ester oil.

In accordance with the present invention, the bushing 1 has an outer shell 2 which is moulded in one piece. The shell 2 extends longitudinally essentially along the whole length of the bushing to prevent leaking at any joints. At the bottom end 13*b* of the bushing, the shell 2 sealingly abuts the conductor 4 (or a bottom section of the bushing which is fastened around the conductor 4, or to a pipe or tube, e.g. a winding tube as mentioned above), e.g. as shown in FIG. 2 at least partly by means of a circumferential groove 10 in the shell 2 for sealingly meshing with an O-ring or other sealing means 11 fitted around the conductor 4 in order to provide a liquid tight seal for preventing leakage between the shell and the conductor at the bottom part 13*b* of the bushing. In order to control the electrical field formed inside the bushing when current flows through the conductor 4, the bushing may comprise a cylindrical condenser core 5, between the shell 2 and the conductor 4, longitudinally surrounding (and defining) the through hole 9. In order to be able to position the condenser core 5 inside the shell 2, the shell 2 may not be configured to sealingly abut the conductor 4 at the top part 13*a* of the bushing. Rather, a lid 3 may be used which may function as a seal between the shell 2 and the conductor 4 at the top 13*a*. Since the lid is at the first longitudinal end 13*a* which is intended to function as the top of the bushing, the liquid sealing properties of the lid may in some embodiments be less critical than at the second/bottom end 13*b*. To reduce the creepage (leak currents) along the outside of the shell 2, the shell may be provided with ridges.

The moulded shell 2 is configured for being fastened to the wall 7 of an electrical apparatus 12. Since the apparatus 12 may be liquid-filled, the shell 2 may conveniently form a relatively liquid tight seal between the bushing 1 and the wall 7. This may be achieved, liquid tight or not, by fastening means of e.g. a circumferential flange 6 of the shell 2, configured to lay flat against the outside of the wall 7 around the bushing. The flange 6 may be provided with one or more holes for allowing screws or bolts to pass there through to fastening the flange 6 to the wall 7. For instance a metal insert 8 e.g. a nut 8 or the like, preferably of metal, may be at least partly moulded into the flange 6 to define a hole there through, i.e. the metal insert 8 is put in the flange during moulding of the shell 2. Thus, a metal reinforced hole through the flange 6 may be provided, which hole may be provided with a threading by means of the (metallic) insert or nut, or the nut may be unthreaded and only provide reinforcement of the hole for a bolt to pass there through.

In some embodiments, the second end 13*b* of the bushing 1 is configured for sealingly abutting the conductor 4, e.g. by comprising a groove 10 for meshing with an O-ring 11 around the conductor. Thus, a liquid tight seal may be provided at the bottom of the bushing when liquid-filled.

In some embodiments, the first end 13*a* of the bushing is configured for sealingly meshing with a lid 3 of the bushing. Thus, a liquid tight seal may be provided at the top of the bushing when liquid-filled.

In some embodiments, the means for fastening the bushing 1 to the wall 7 comprises a flange 6 of the moulded shell 2, the flange comprising a threaded nut 8 defining a hole through the flange moulded into the flange and the flange being configured for lying flat against an outside of the wall 7.

In some embodiments, the bushing 1 comprises a condenser core 5 positioned along and surrounding the longitudinal through hole 9.

In some embodiments, the shell 2 is provided with means for connecting the condenser core 5 to neutral through the moulded shell, e.g. an electrical conductor moulded into the shell. It may be necessary to connect the condenser core 5 to neutral (ground/earth) outside of the bushing. Since the shell 2 is of an electrically insulating material, a conductor e.g. a metal thread or wire may be moulded into and through the shell 2 during moulding of the shell 2 for connecting the condenser core 5 with e.g. the wall 7 of the electrical apparatus 12.

In some embodiments, the polymeric material is of a thermosetting resin, such as an epoxy resin. The polymeric material may be made from any mouldable resin, e.g. a thermoplastic resin or a thermosetting resin. In view of the potentially elevated operating temperatures of the apparatus 12, a thermosetting resin may be preferred and an epoxy-based resin may have suitable properties for forming the shell 2. However, any other polymer resin may be suitable depending on the situation which the bushing should be adapted to, e.g. a polyester-based resin. The insulating polymeric material may comprise a filler e.g. of a ceramic material.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. An electrical bushing configured for extending through a wall of an electrical apparatus, the bushing comprising:

an electrically insulating shell having a central longitudinal through hole as well as a first longitudinal end configured to be at a top of the bushing outside of the electrical apparatus and a second longitudinal end configured to be at a bottom of the bushing inside of the electrical apparatus;

a circumferential groove formed in the shell at the second longitudinal end;

wherein the bushing is configured for accommodating an electrical conductor positioned through the central longitudinal through hole of the shell;

wherein the shell includes fastening means for fastening the bushing to the wall of the electrical apparatus, through which wall the bushing is configured for allowing the electrical conductor to pass;

wherein the shell is configured to sealingly contain an electrically insulating liquid in the bushing by means of the circumferential groove that sealingly meshes with a seal fitted around the electrical conductor, allowing the bushing to be liquid-filled and being configured to prevent leakage between the shell and the electrical conductor at the second longitudinal end; and wherein the shell is moulded as a single piece from an electrically insulating polymeric material.

2. The bushing of claim 1, wherein the second longitudinal end is configured to sealingly abut the electrical conductor by meshing with the seal in the form of an O-ring around the electrical conductor.

3. The bushing according to claim 2, wherein the first longitudinal end is configured for sealingly meshing with a lid of the bushing.

4. The bushing of claim 1, wherein the first longitudinal end is configured to sealingly mesh with a lid of the bushing.

5. The bushing of claim 1, wherein the means for fastening includes a flange of the shell, the flange including a metal insert.

6. The bushing of claim 5, wherein the metal insert defines a hole through the flange and is moulded into the flange, and wherein the flange is configured for lying flat against an outside of the wall.

7. The bushing of claim 6, wherein the metal insert comprises a threaded nut.

8. The bushing of claim 1, further including a condenser core positioned along and surrounding the longitudinal through hole.

9. The bushing of claim 8, wherein the shell is provided with means for connecting the condenser core to neutral through the shell.

10. The bushing of claim 9, wherein the means for connecting the condenser core to neutral comprises an electrical conductor moulded into the shell.

11. The bushing of claim 1, wherein the polymeric material comprises a thermosetting resin.

12. The bushing of claim 11, wherein the thermosetting resin comprises an epoxy resin.

13. An electrical apparatus comprising:

a bushing that includes:

an electrically insulating shell having a central longitudinal through hole as well as a first longitudinal end configured to be at a top of the bushing outside of the electrical apparatus and a second longitudinal end configured to be at a bottom of the bushing inside of the electrical apparatus;

a circumferential groove formed in the shell at the second longitudinal end;

wherein the bushing is configured for accommodating an electrical conductor positioned through the central longitudinal through hole of the shell;

wherein the shell includes fastening means for fastening the bushing to a wall of the electrical apparatus, through which wall the bushing is configured for allowing the electrical conductor to pass;

wherein the shell is configured to sealingly contain an electrically insulating liquid in the bushing by means of the circumferential groove that sealingly meshes with a seal fitted around the electrical conductor, allowing the bushing to be liquid-filled and being configured to prevent leakage between the shell and the electrical conductor at the second longitudinal end; and wherein the shell is moulded as a single piece from an electrically insulating polymeric material;

the bushing being liquid-filled, extending through the wall of the electrical apparatus and being fastened to said wall by means of the fastening means.

14. The apparatus of claim 13, wherein the electrical apparatus is a liquid-filled transformer.

15. A method of moulding a shell for an electrical bushing including:

using an electrically insulating polymeric material to mould the shell as a single piece, the electrically insulating shell having a central longitudinal through hole as well as a first longitudinal end configured to be at a top of the bushing outside of an electrical apparatus and a second longitudinal end configured to be at a bottom of the bushing inside of the electrical apparatus, the shell having a circumferential groove formed at the second longitudinal end;

wherein the bushing is configured for accommodating an electrical conductor positioned through the central longitudinal through hole of the shell;

wherein the shell includes fastening means for fastening the bushing to a wall of the electrical apparatus, through which wall the bushing is configured for allowing the electrical conductor to pass;

wherein the shell is configured to sealingly contain an electrically insulating liquid in the bushing by means of the circumferential groove that sealingly meshes with a seal fitted around the electrical conductor, allowing the bushing to be liquid-filled and being configured to prevent leakage between the shell and the electrical conductor at the second longitudinal end.

* * * * *